US008733869B2

(12) United States Patent
Ohhashi

(10) Patent No.: US 8,733,869 B2
(45) Date of Patent: May 27, 2014

(54) LIQUID EJECTION APPARATUS HAVING RETRACTABLE HEADS

(75) Inventor: Masashi Ohhashi, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 204 days.

(21) Appl. No.: 13/070,071

(22) Filed: Mar. 23, 2011

(65) Prior Publication Data

US 2011/0234663 A1 Sep. 29, 2011

(30) Foreign Application Priority Data

Mar. 25, 2010 (JP) ..... 2010-070539

(51) Int. Cl.
*B41J 29/38* (2006.01)

(52) U.S. Cl.
USPC ..... 347/9

(58) Field of Classification Search
None
See application file for complete search history.

(56) References Cited

U.S. PATENT DOCUMENTS

| | | | | |
|---|---|---|---|---|
| 6,231,156 | B1 | 5/2001 | Ono | |
| 2002/0167576 | A1* | 11/2002 | Koitabashi et al. | 347/101 |
| 2003/0043230 | A1 | 3/2003 | Koitabashi et al. | |
| 2005/0231742 | A1* | 10/2005 | Hirano | 358/1.9 |
| 2006/0197802 | A1 | 9/2006 | Konno | |
| 2008/0074450 | A1 | 3/2008 | Konno | |
| 2009/0135218 | A1* | 5/2009 | Morohoshi et al. | 347/9 |

FOREIGN PATENT DOCUMENTS

| | | | | |
|---|---|---|---|---|
| JP | H11-199182 A | | 7/1999 | |
| JP | 11240165 A | * | 9/1999 | B41J 2/165 |
| JP | H11-240165 A | | 9/1999 | |
| JP | 2001-001509 A | | 1/2001 | |
| JP | 2001001509 A | * | 1/2001 | B41J 2/01 |
| JP | 2002-059559 A | | 2/2002 | |
| JP | 2002059559 A | * | 2/2002 | B41J 2/165 |
| JP | 2002-154196 A | | 5/2002 | |
| JP | 2002-347255 A | | 12/2002 | |
| JP | 2004-106359 A | | 4/2004 | |
| JP | 2004106359 A | * | 4/2004 | B41J 2/01 |
| JP | 2006-240094 A | | 9/2006 | |

OTHER PUBLICATIONS

European Patent Office, extended European Search Report for European Patent Application No. 11159056.8 (counterpart to above-captioned patent application), dated Mar. 26, 2012.
Japan Patent Office, Notification of Reasons for Refusal for Japanese Patent Application No. 2010-070539 (counterpart to above-captioned patent application), dispatched Feb. 28, 2012.

* cited by examiner

*Primary Examiner* — Geoffrey Mruk
*Assistant Examiner* — Bradley Thies
(74) *Attorney, Agent, or Firm* — Baker Botts L.L.P.

(57) ABSTRACT

A liquid ejecting apparatus, including: a first ejecting head for ejecting a black ink; a second ejecting head disposed upstream of the first head and configured to eject a liquid that acts on an ink; third ejecting heads disposed downstream of the second head and configured to respectively eject color inks, the third ejecting heads including a specific third ejecting head disposed between the first and second heads; a head moving mechanism configured to move the specific third head between a print position and a retracted position; and a controller which controls the apparatus and which includes, an image-data storage portion, a head control portion configured to control the heads, and a head-movement control portion configured to control the head moving mechanism to move the specific third head from the print position to the retracted position when monochrome printing is conducted in which only the black ink is ejected.

10 Claims, 10 Drawing Sheets

LIQUID EJECTION APPARATUS HAVING RETRACTABLE HEADS

CROSS REFERENCE TO RELATED APPLICATION

The present application claims priority from Japanese Patent Application No. 2010-070539, which was filed on Mar. 25, 2010, the disclosure of which is herein incorporated by reference in its entirety.

BACKGROUND OF THE INVENTION

1. Field of the Invention

The present invention relates to a liquid ejecting apparatus for forming an image on a recording medium.

2. Discussion of Related Art

There is known an ink-jet printer having a plurality of ink-jet heads for ejecting ink and a treatment-liquid ejecting head for ejecting a treatment or processing liquid that insolubilizes a colorant in the ink. The ink-jet heads and the treatment-liquid ejecting head are arranged in a conveyance direction in which a recording sheet is conveyed. In such an ink-jet printer, the treatment-liquid ejecting head is generally disposed upstream of the ink-jet heads in the conveyance direction. Further, a distance in the conveyance direction between the treatment-liquid ejecting head and one ink-jet head disposed adjacent thereto is made larger than a distance between any adjacent two ink-jet heads. Accordingly, mist of the treatment liquid generated by ejection from the treatment-liquid ejecting head is not likely to adhere to the ejection surface of the ink-jet head adjacent to the treatment-liquid ejecting head. Therefore, it is possible to avoid insoubilization due to adhesion of the mist of the treatment liquid to the ejection openings, thereby suppressing ejection failure of the ink-jet head.

SUMMARY OF THE INVENTION

In the ink-jet printer described above, the treatment-liquid ejecting head and the ink-jet head disposed next thereto are spaced apart from each other by a relatively large distance, inevitably increasing the size of the printer in the conveyance direction.

It is therefore an object of the invention to provide a liquid ejecting apparatus in which an increase of the size of the apparatus in the conveyance direction is restrained while adhesion of mist of the liquid is restrained.

The above-indicated object may be attained according to a principle of the invention, which provides a liquid ejecting apparatus, comprising:

a conveyor mechanism configured to convey a recording medium in a conveyance direction;

a first ejecting head which has a first ejection surface having first ejection openings formed therein for ejecting a black ink to the recording medium;

a second ejecting head which is disposed upstream of the first ejecting head in the conveyance direction and which has a second ejection surface having second ejection openings for ejecting a liquid that acts on an ink so as to cause one of coagulation and precipitation of a component in the ink;

a plurality of third ejecting heads which are disposed downstream of the second ejecting head in the conveyance direction and which respectively have third ejection surfaces having third ejection openings formed therein for ejecting color inks having mutually different colors other than black to the recording medium, the plurality of third ejecting heads including a specific third ejecting head disposed between the first ejecting head and the second ejecting head in the conveyance direction;

a head moving mechanism configured to move the specific third ejecting head between: a print position where one of the color inks is ejected from the specific third ejecting head to the recording medium; and a retracted position where the specific third ejecting head and the conveyor mechanism are spaced apart from each other by a distance larger than that when the specific third ejecting head is located at the print position; and a controller which is configured to control the liquid ejecting apparatus and which includes:

an image-data storage portion configured to store image data of an image to be recorded on the recording medium as ejection data for ejecting the black ink and the color inks respectively from the first and third ejecting heads and the liquid from the second ejecting head;

a head control portion configured to control the first and the third ejecting heads to respectively eject the black ink and the color inks and to control the second ejecting head to eject the liquid, on the basis of the ejection data stored in the image-data storage portion, such that image dots are formed on the recording medium; and a head-movement control portion configured to control the head moving mechanism to move the specific third ejecting head from the print position to the retracted position when monochrome printing is conducted in which only the black ink is ejected from the first ejecting head.

BRIEF DESCRIPTION OF THE DRAWINGS

The above and other objects, features, advantages and technical and industrial significance of the present invention will be better understood by reading the following detailed description of embodiments of the invention, when considered in connection with the accompanying drawings, in which.

DETAILED DESCRIPTION OF THE EMBODIMENTS

There will be hereinafter described preferred embodiments of the invention with reference to the drawings.

Figure 1:
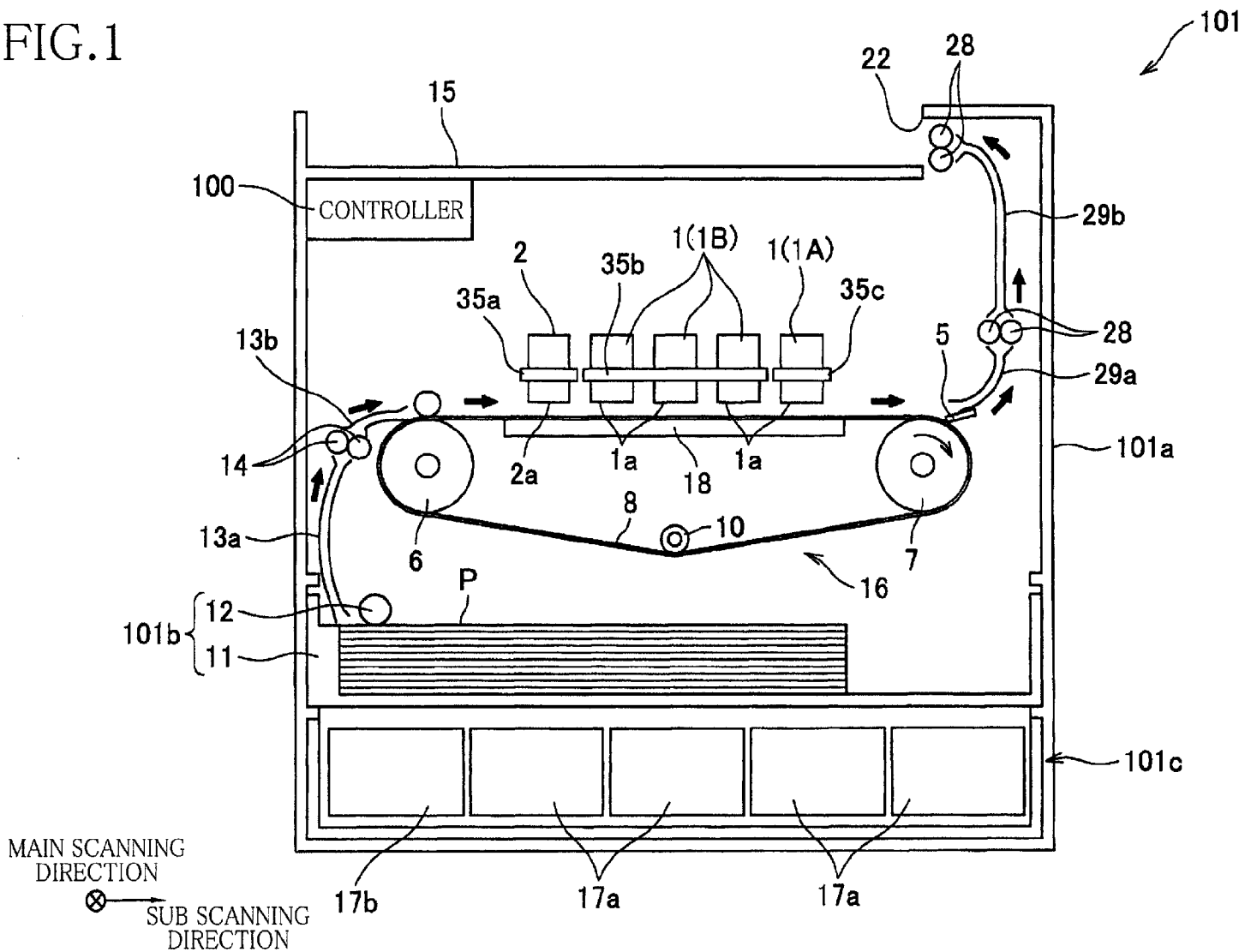
FIG. 1 is a side view in cross section schematically showing an overall structure of an ink-jet printer according to one embodiment of the invention.

As shown in FIG. 1, an ink-jet printer 101 as a liquid ejecting apparatus constructed according to one embodiment of the invention has a housing 101*a* having a generally rectangular parallelepiped shape. In the housing 101*a*, there are disposed: a sheet conveyor mechanism 16 configured to convey a sheet P as a recording medium in a conveyance direction, namely, a direction from the left to the right in FIG. 1; four ink-jet heads 1 (1A and 1B) configured to eject droplets of a yellow ink, a cyan ink, a magenta ink, and a black ink, respectively, to the sheet P conveyed by the sheet conveyor mechanism 16; a pre-coat head 2 as a second ejecting head configured to eject droplets of a pre-coat liquid which causes coagulation or precipitation of a colorant (coloring matter) contained in each ink; a head moving mechanism 33 (FIG. 6); a capping mechanism 34 (FIG. 5); a sheet supply unit 101*b* configured to supply the sheets P; a tank unit 101*c* for storing the inks and the pre-coat liquid; and a controller 100 configured to control overall operations of the ink-jet printer 101. On a top plate of the housing 101*a*, there is provided a discharged-sheet receiving portion 15 to which the sheet P is discharged.

In the present embodiment, a sub scanning direction is a direction which is parallel to the conveyance direction in which the sheet P is conveyed by the sheet conveyor mechanism 16 while a main scanning direction is a direction which is horizontal and which is perpendicular to the sub scanning direction.

The tank unit 101*c* accommodates therein four ink tanks 17*a* and one pre-coat liquid tank 17*b*. The ink tanks 17*a* and the pre-coat liquid tank 17*b* are removably attached to the tank unit 101*c*. The four ink tanks 17*a* respectively store the magenta ink, the cyan ink, the yellow ink, and the black ink, and the inks are supplied to the corresponding ink-jet heads 1A, 1B through respective ink tubes (not shown). The pre-coat liquid tank 17*b* stores the pre-coat liquid to be supplied to the pre-coat head 2 through a tube. In general, a pre-coat liquid which coagulates a pigment colorant is used for a pigment ink while a pre-coat liquid which precipitates a dye colorant is used for a dye ink. The material for the pre-coat liquid is suitably selected. For example, there may be used a liquid that contains a cationic high polymer or a polyvalent metallic salt such as a magnesium salt. When an ink is attached to a region of the sheet P which has been coated with the pre-coat liquid, the polyvalent metallic salt or the like acts on a dye or a pigment as a colorant of the ink, whereby insoluble or sparingly soluble metal complex or the like is formed by coagulation or precipitation.

The sheet supply unit 101*b* is removably disposed relative to the housing 101*a* and includes a sheet tray 11 and a sheet supply roller 12. The sheet tray 11 has a box-like shape opening upwards, and a stack of the sheets P is accommodated in the sheet tray 11. The sheet supply roller 12 is configured to supply an uppermost one of the sheets 11 accommodated in the sheet tray 11 under the control of the controller 100. The sheet P supplied by the sheet supply roller 12 is fed to the sheet conveyor mechanism 16 by a feed roller pair 14 along guides 13*a*, 13*b*.

The sheet conveyor mechanism 16 includes two belt rollers 6, 7, a conveyor belt 8, a tension roller 10, and a platen 18. The conveyor belt 8 is an endless belt wound around the two belt rollers 6, 7, and tension is given to the conveyor belt 8 by the tension roller 10. The platen 18 is disposed so as to be opposed to the four ink-jet heads 1A, 1B and the pre-coat head 2 and supports an upper portion of the loop of the conveyor belt 8 from inside the loop. According to the arrangement, there is formed a prescribed clearance suitable for image formation, between the outer surfaces of the conveyor belt 8 and the ejection surfaces of the four ink-jet heads 1A, 1B and the pre-coat head 2. The belt roller 7 is a drive roller configured to rotate clockwise in FIG. 1 by being driven by a motor (not shown), so as to move or run the conveyor belt 8. The belt roller 6 is a driven roller configured to rotate by the movement of the conveyor belt 8. A silicone layer with low tackiness is formed on the outer surface of the conveyor belt 8, whereby the conveyor belt 8 supports the sheet P placed thereon. Accordingly, the sheet conveyor mechanism 16 can convey the sheet placed on the conveyor belt 8 in the conveyance direction.

Figure 3:
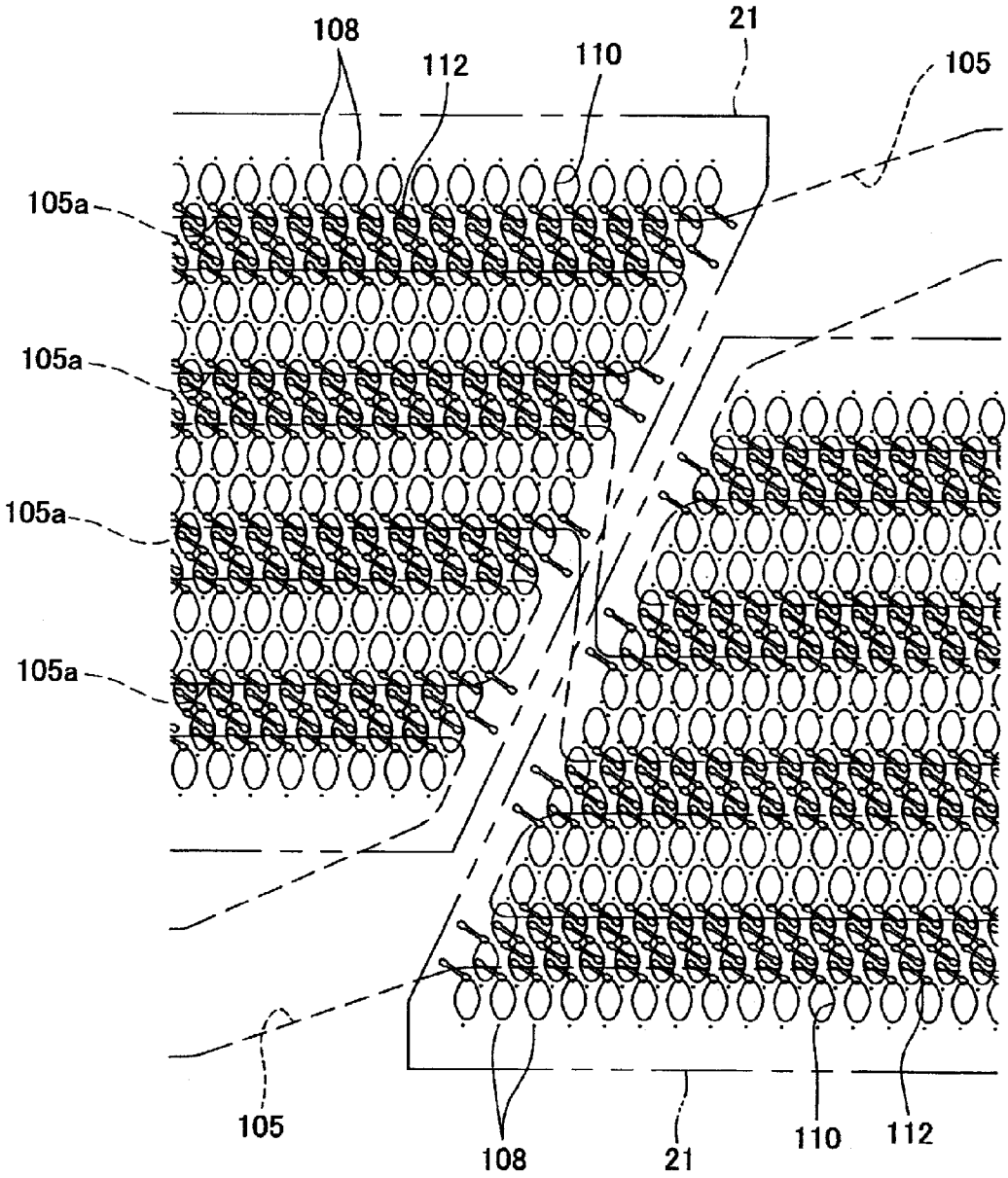
FIG. 3 is an enlarged view showing a region enclosed by a dot-dash line in FIG. 2.

The four ink-jet heads 1A, 1B and the pre-coat head 2 have the same structure. The four ink-jet heads 1A, 1B and the pre-coat head 2 extend in the main scanning direction and are arranged so as to be in parallel with each other and equally spaced apart from each other in the sub scanning direction. The pre-coat head 2 is disposed upstream of the four ink-jet heads 1A, 1B in the conveyance direction. As shown in FIG. 3, the lower surface of the ink-jet head 1A functions as a first ejection surface 1*a* in which first ejection openings 108 are formed, the lower surface of the pre-coat head 2 functions as a second ejection surface 2*a* in which second ejection openings 108 are formed, and the lower surface of each ink-jet head 1B functions as a third ejection surface 1*a* in which third ejection openings 108 are formed. That is, the printer 101 is a line-type color ink-jet printer in which the plurality of ejection openings 108 from which ink droplets are ejected are arranged in the main scanning direction.

One of the four ink-jet heads 1A, 1B that is disposed the most downstream in the conveyance direction, namely, the ink-jet head 1A as a first ejecting head, is configured to eject the black ink. (The ink-jet head 1A may be hereinafter referred to as the "black ink-jet head" where appropriate.) The other three ink-jet heads 1B each as a third ejecting head are configured to respectively eject the color inks other than the black ink, namely, the magenta ink, the cyan ink, and the yellow ink. (Each of the three ink-jet heads 1B may be hereinafter referred to as the "color ink-jet head" where appropriate.) One of those three color ink-jet heads 1B that is disposed the most upstream in the conveyance direction ejects the yellow ink having the highest lightness, and the other two color ink-jet heads 1B respectively eject the cyan ink and the magenta ink. Thus, the four ink-jet heads 1A, 1B are disposed so as to respectively eject the inks whose lightness becomes lower toward the downstream side in the conveyance direction. It is noted that each of the three color ink-jet heads 1B may be referred to as a specific third ejecting head since the three color ink-jet heads 1B are located so as to be interposed, in the conveyance direction, between the second ejecting head in the form of the pre-coat head 2 and the first ejecting head in the form of the black ink-jet head 1A.

The outer surface of the upper portion of the loop of the conveyor belt 8 and the ejection surfaces 1*a*, 2*a* are opposed to each other so as to be in parallel with each other. When the sheet P conveyed by the conveyor belt 8 passes right below the pre-coat head 2, the droplets of the pre-coat liquid are ejected from the pre-coat head 2 such that a region of the upper surface of the sheet P on which an image is to be formed is coated with the pre-coat liquid. When the sheet P subsequently passes right below the four ink-jet heads 1A, 1B, the droplets of the respective inks are ejected in order from the four ink-jet heads 1A, 1B to the above-indicated region of the upper surface of the sheet P which has been coated with the pre-coat liquid. Thus, an intended color image is formed on the sheet P. In this instance, when the ink droplets are attached onto the pre-coat liquid that has been applied to the sheet P, the pre-coat liquid causes coagulation or precipitation of the colorant of the ink droplets, thereby preventing the ink from spreading on the sheet R On the downstream side of the four ink-jet heads 1A, 1B in the conveyance direction, a separation plate 5 is disposed. The sheet P conveyed in the conveyance direction by the sheet conveyor mechanism 16 is separated by the separation plate 5 from a conveyor surface of the conveyor belt 8 after having passed in order below the pre-coat head 2 and the four ink-jet heads 1A, 1B. The sheet P separated by the separation plate 5 is fed upwards by two feed roller pairs 28 along guides 29*a*, 29*b* and is finally discharged to the discharged-sheet receiving portion 15 through a discharge opening 22 formed at the upper portion of the housing 101*a*.

Figure 2:
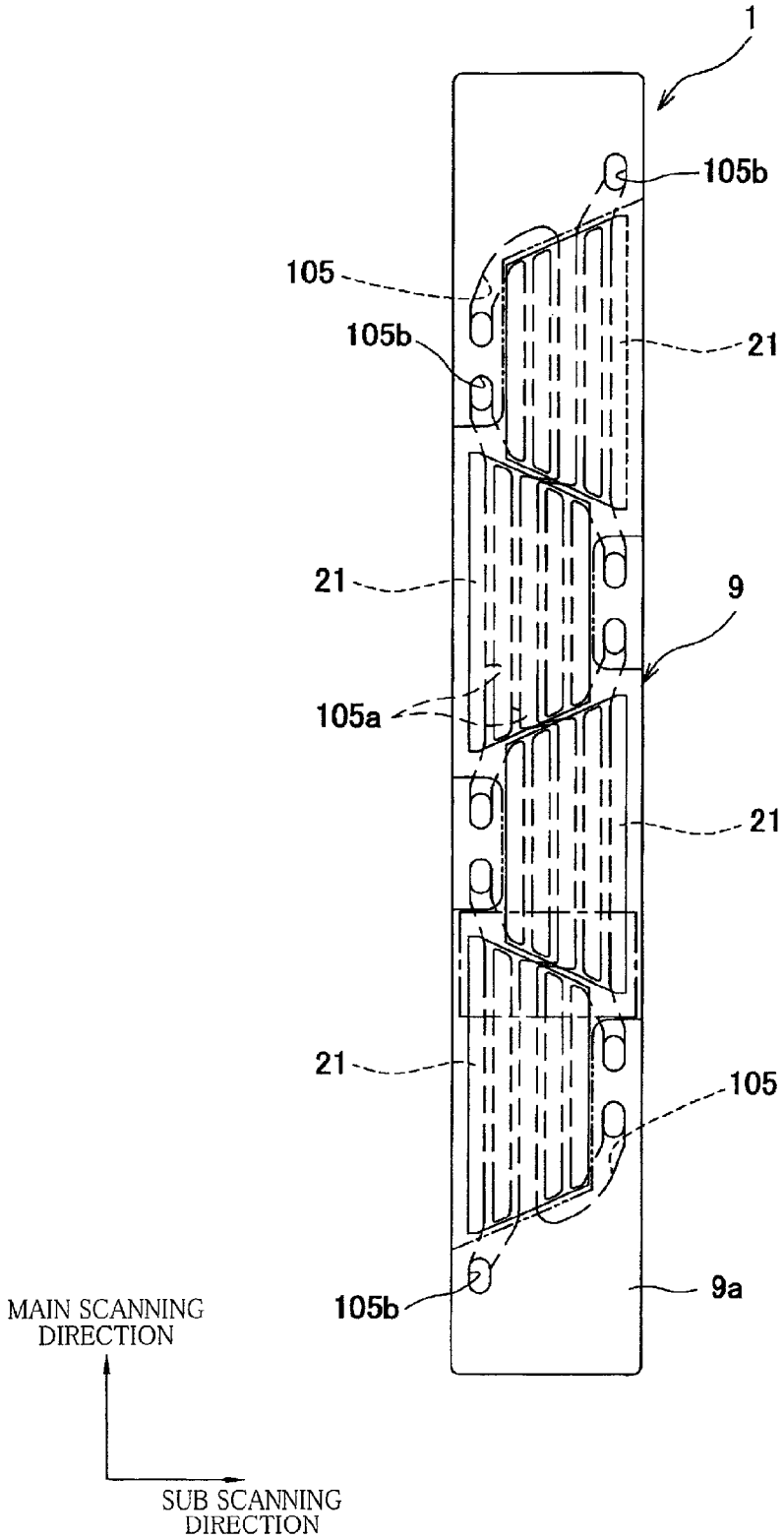
FIG. 2 is a plan view of an ink-jet head shown in FIG. 1.
Figure 4:
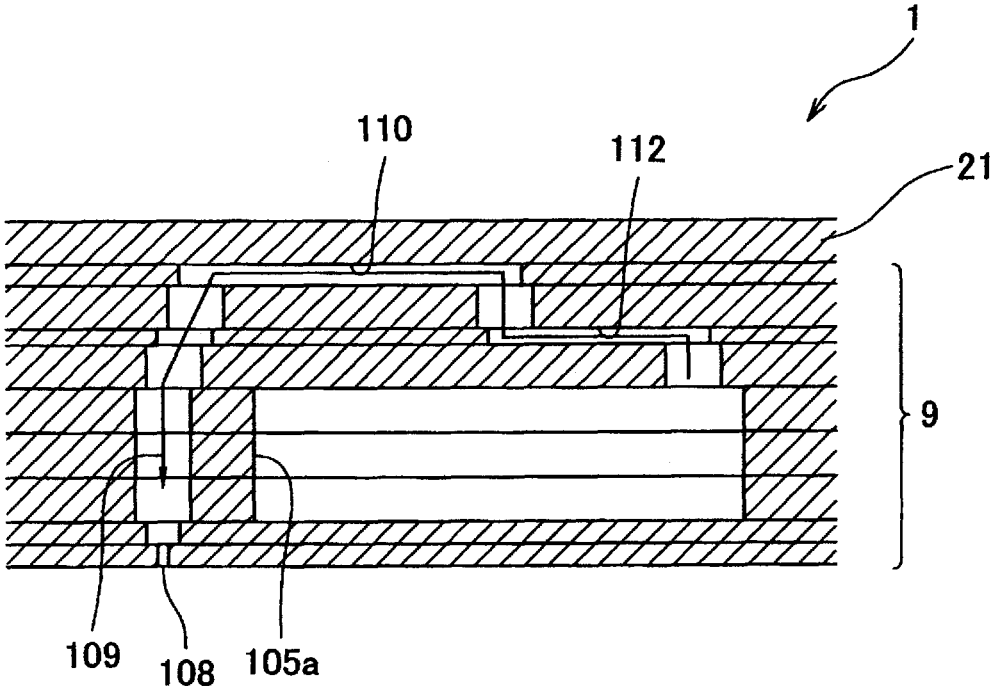
FIG. 4 is a cross-sectional view of a part of the ink-jet head shown in FIG. 2.

With reference to FIGS. 2-4, each head 1, 2 will be explained. Since the pre-coat head 2 has the same structure as the ink-jet heads 1, its detailed explanation is dispensed with. In FIG. 3, pressure chambers 110, apertures 112, and the ejection openings 108 which are located under actuator units 21 and therefore should be indicated by a broken line are indicated by a solid line for convenience of explanation.

As shown in FIG. 2, each ink-jet head 1 has a laminated structure in which four actuator units 21 are fixed to an upper surface 9*a* of a flow-passage unit 9. While not shown, each of the ink-jet heads 1 and the pre-coat head 2 includes a reservoir unit storing the ink or the pre-coat liquid to be supplied to the flow-passage unit 9, a flexible printed circuit (FPC) for supplying drive signals to the actuator units 21, a control circuit for controlling a driver IC mounted on the FPC, and so on.

As shown in FIG. 4, the flow-passage unit 9 is a laminated body in which a plurality of metal plates each formed of stainless steel are superposed on one another so as to be positioned relative to one another. In the flow-passage unit 9, there are formed a multiplicity of individual ink channels 109 each extending from the corresponding manifold 105 and sub manifold 105*a* (FIGS. 2 and 3) and reaching the corresponding ejection opening 108 via an outlet of the corresponding sub manifold 105*a*, the corresponding aperture 112, and the corresponding pressure chamber 110. Each actuator unit 21 includes a plurality of actuators respectively corresponding to the pressure chambers 110 and has a function of giving ejection energy selectively to the ink in the pressure chambers 110.

As shown in FIG. 2, ten ink supply holes 105*b* are open in the upper surface 9*a* of the flow-passage unit 9 so as to correspond to ink outflow passages formed in the reservoir unit. The lower surface of the flow-passage unit 9 is formed as the ejection surface 1*a*, and a multiplicity of ejection openings 108 are formed in matrix. In this respect, the ejection openings 108 are arranged at intervals of 600 dpi in the main scanning direction that corresponds to resolution in the main scanning direction.

There will be explained an ink flow in the flow-passage unit 9. As shown in FIGS. 3 and 4, the ink supplied from the reservoir unit to the flow-passage unit 9 via one ink supply hole 105*b* is distributed into the sub manifolds 105*a* from the corresponding manifold 105. The ink in the sub manifolds 105*a* flows into the individual ink channels 109 and reach the ejection openings 108 via the corresponding pressure chambers 110.

As shown in FIG. 1, the four ink-jet heads 1A, 1B and the pre-coat head 2 are fixed to frames 35*a*-35*c*. More specifically, the pre-coat head 2 is fixed to the frame 35*a*, the three color ink-jet heads 1B for respectively ejecting the yellow ink, the cyan ink, and the magenta ink are fixed to the frame 35*b*, and the ink-jet head 1A for ejecting the black ink is fixed to the frame 35*c*. The head moving mechanism 33 is configured to move the frames 35*a*-35*c* upward and downward such that each of the heads 1, 2 is selectively placed between: a print position (FIG. 1) at which the heads 1 eject the respective inks to the sheet P and the head 2 ejects the pre-coat liquid to the sheet P, in a printing operation; and a retracted position (FIGS. 8 and 9) at which the heads 1, 2 are spaced apart from the sheet conveyor mechanism 16 by a distance larger than that when the heads 1, 2 are located at the print position. Further, a space in which caps 71-73 and trays 76-78 (explained below) can be disposed is formed between the sheet conveyor mechanism 16 and the heads 1, 2 which have been moved to the retracted position by the head moving mechanism 33. According to the arrangement, the caps 71-73 and the trays 76-78 which are normally located, for standby, remote from the space in the main scanning direction are moved into the space, so as to cover the ejection surfaces 1*a*, 2*a* of the heads 1, 2 with the caps 71-73. In a strict sense, the printing position and the retracted position differ among the heads 1, 2. However, the printing positions of the respective heads 1, 2 are not distinguished from each other for convenience of explanation. Similarly, the retracted positions of the respective heads 1, 2 are not distinguished from each other for convenience of explanation.

Figure 5A:
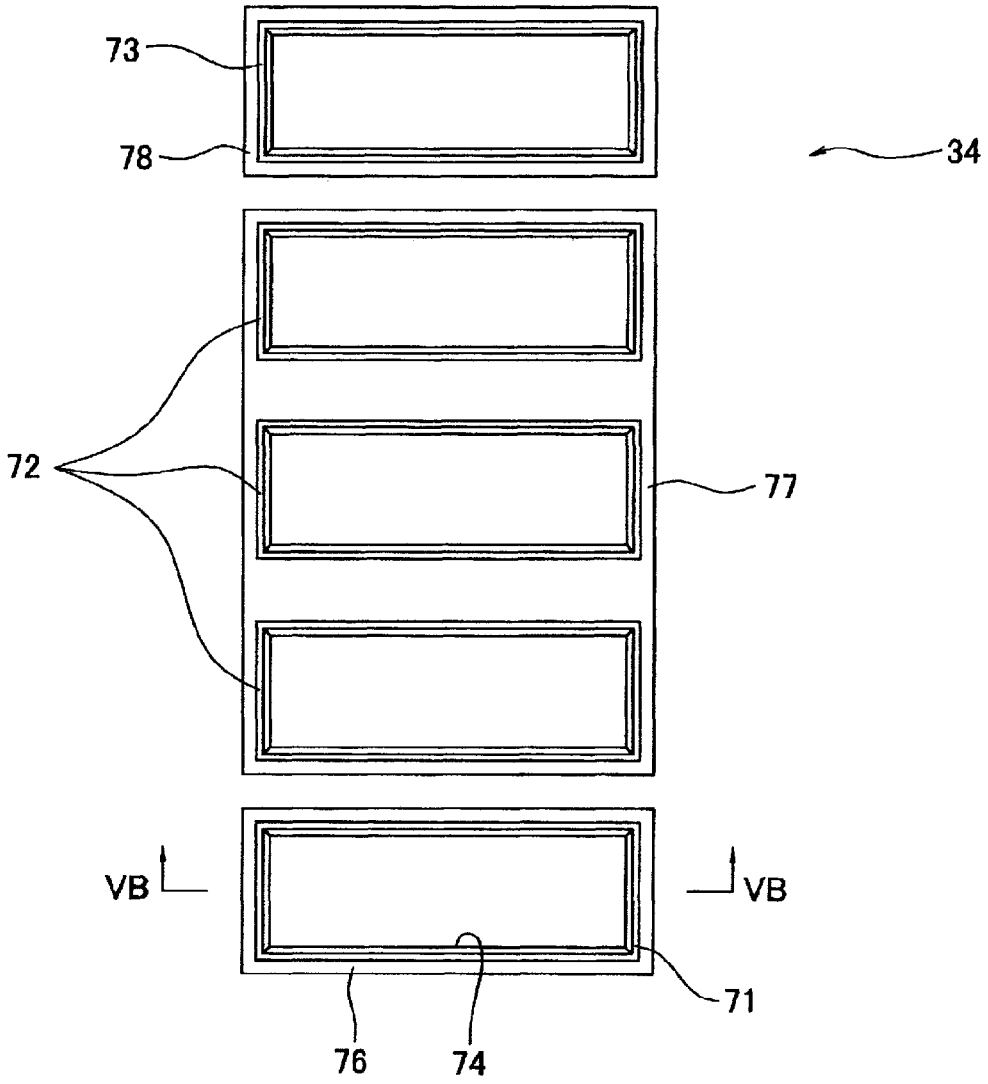
FIG. 5A is a plan view of a capping mechanism and FIG. 5B is a cross-sectional view taken along line VB-VB in FIG. 5A.
Figure 5B:
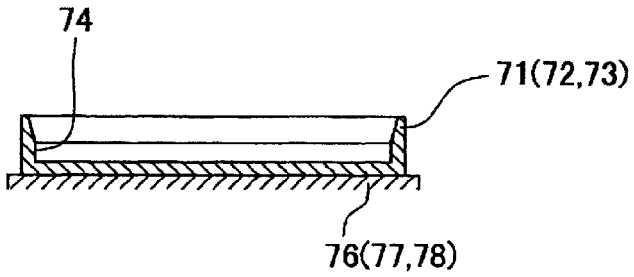

As shown in FIG. 5, the capping mechanism 34 includes five caps 71-73, a tray 76 for supporting the cap 71, a tray 77 for supporting three caps 72, a tray 78 for supporting the cap 73, and a tray moving mechanism (not shown) by which the three trays 76-78 can be moved in the main scanning direction. The tray moving mechanism is configured to move each of the trays 76-78 in the main scanning direction so as to be selectively placed between: a standby position at which the trays 76-78 (the caps 71-73) are away or remote, in the main scanning direction, from the heads 1, 2 which are located at the print position and the caps 71-73 are not opposed to the ejection surfaces 1*a*, 2*a*; and a capping position (FIGS. 8 and 9) at which the caps 71-73 are opposed to the ejection surfaces 1*a*, 2*a* of the heads 1, 2 which are located at the retracted position. Each of the caps 71-73 is an elastic member having a recess 74 and is configured to cover a corresponding one of the ejection surfaces 1*a*, 2*a* such that the tip of each cap 71-73 that defines the open end of the recess 74 is held in abutting contact with the corresponding ejection surface 1*a*, 2*a*. The side wall of each cap 71-73 that defines the periphery of the recess 74 has a tapered inner wall surface which inclines outwardly, namely, the side wall has a wall thickness which gradually reduces toward the tip of the cap 71-73.

Figure 6:
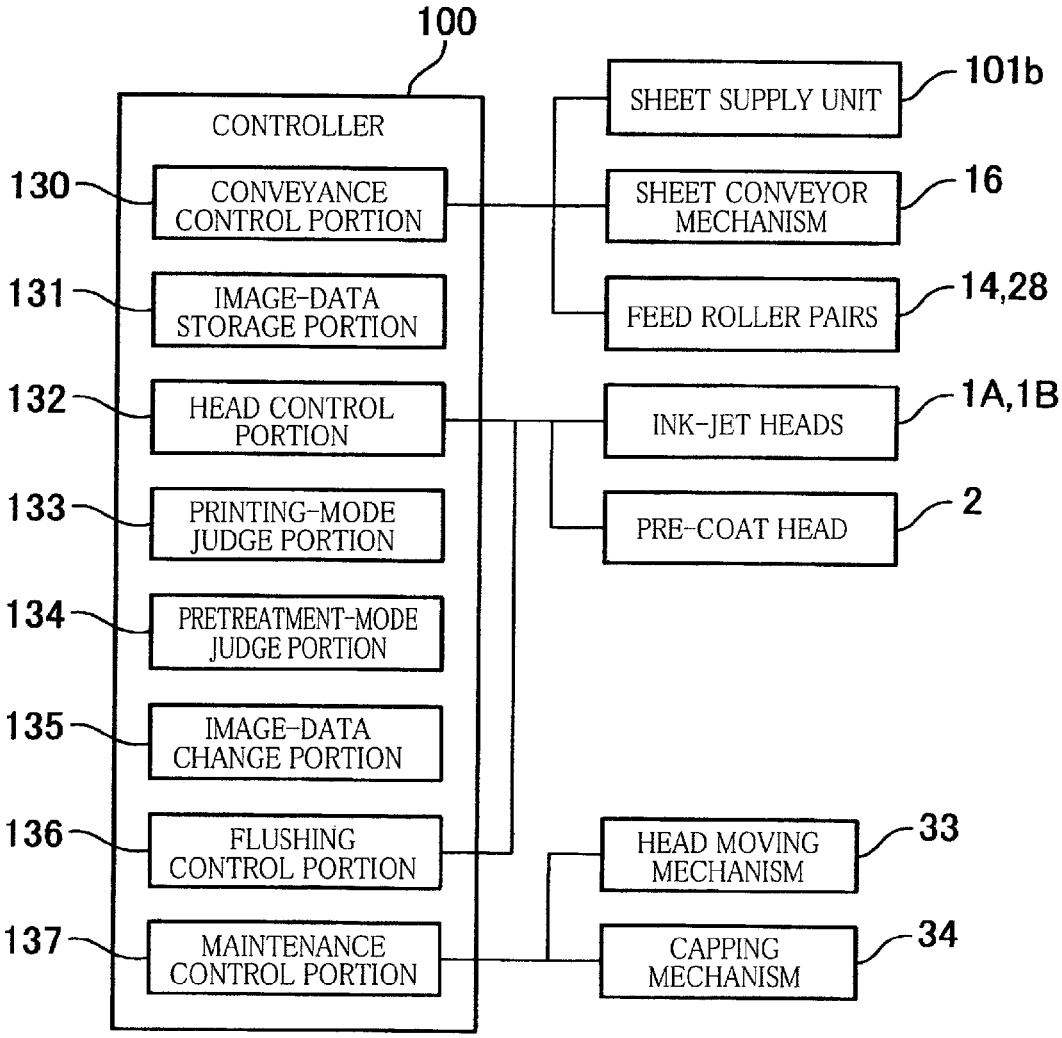
FIG. 6 is a block diagram schematically showing a structure of a controller shown in FIG. 1.

Referring next to FIG. 6, the controller 100 will be explained. The controller 100 includes a Central Processing Unit (CPU), an Electrically Erasable and Programmable Read Only Memory (EEPROM) which stores programs to be executed by the CPU and which rewritably stores data to be utilized in the programs, and a Random Access Memory (RAM) which temporarily stores data when the programs are executed. Functional portions that constitute the controller 100 are established by cooperation of the hardware indicated above and software in the EEPROM. As shown in FIG. 6, the controller 100 controls the ink-jet printer 101 as a whole and includes a conveyance control portion 130, an image-data storage portion 131, a head control portion 132, a printing-mode judge portion 133, a pretreatment-mode judge portion 134, an image-data change portion 135, a flushing control portion 136, and a maintenance control portion 137.

The conveyance control portion 130 is configured to control the sheet supply unit 101*b*, the feed roller pairs 14, 28, and the sheet conveyor mechanism 16 such that the sheet P is conveyed in the conveyance direction. The image-data storage portion 131 stores image data which is transmitted from a personal computer (PC) or the like and which relates to an image to be printed on the sheet P, as ejection data based on which the inks of the respective ink-jet heads 1A, 1B and the pre-coat liquid of the pre-coat head 2 are ejected. In the present embodiment, the ejection data indicates an amount of each ink or the pre-coat liquid to be ejected from each ejection opening 108 in every printing period that is selected from among the following four kinds, namely, zero, a small amount, a medium amount, and a large amount. The ejection data of the pre-coat liquid is determined on the basis of the image data. More specifically, the ejection data of the pre-coat liquid is determined such that the pre-coat liquid is attached to a dot region to which the ink ejected from each of the ink-jet heads 1A, 1B on the basis of the image data is to be attached. In other words, the pre-coat liquid is ejected to a region of the sheet P in which an image is to be formed and the pre-coat liquid is not ejected to a region of the sheet P in which the image is not to be formed.

The printing-mode judge portion 133 is configured to judge, on the basis of the ejection data stored in the image-data storage portion 131, which one of a color printing mode and a monochrome printing mode is to be established. In the monochrome printing mode, monochrome printing is conducted in which the black ink is ejected from the black ink-jet head 1A. In the color printing mode, color printing is conducted in which the inks are ejected from the respective four ink-jet heads 1A, 1B. According to the arrangement, it is possible to judge which one of the color printing and the monochrome printing is to be conducted with respect to the sheet P. Where the printing mode of the printer is set to a user-selected mode in advance, namely, the printing mode is selected in advance by a user, the printing-mode judge portion 133 gives a higher priority to the user settings and judges that the user-selected printing mode is to be established. In other words, where the monochrome printing mode is selected in advance by the user, the printing-mode judge portion 133 judges that the monochrome printing mode is to be established even if the ejection data relating to a color image is stored in the image-data storage portion 131.

The pretreatment-mode judge portion 134 is configured to judge, on the basis of a signal transmitted from the PC or the like and indicative of a type of the sheet P, which one of a pretreatment mode and a non-pretreatment mode is to be established. In the pretreatment mode, there is conducted a pretreatment in which the pre-coat liquid is ejected from the pre-coat head 2 to the sheet P. In the non-pretreatment mode, the pre-coat liquid is not ejected from the pre-coat head 2 and the pretreatment is not conducted. That is, the pretreatment-mode judge portion 134 judges that the non-pretreatment mode is to be established where the sheet P to be used belongs to a paper type such as glossy paper in which the paper surface is coated and accordingly there is no need of attaching the pre-coat liquid thereto. On the other hand, the pretreatment-mode judge portion 134 judges that the pretreatment mode is to be established where the sheet P to be used belongs to a paper type such as plain paper in which the paper surface is not coated and therefore ink spreading can be restrained by attaching the pre-coat liquid thereto. According to the arrangement, it is possible to judge whether or not the pretreatment is to be conducted with respect to the sheet P.

The head control portion 132 is configured to control the pre-coat head 2 to eject droplets of the pre-coat liquid from the ejection openings 108 at intended timing by driving the actuator units 21 of the pre-coat head 2 and to control the ink-jet heads 1A, 1B to eject ink droplets each having an intended volume from the ejection openings 108 at intended timing by driving the actuator units 21 of the respective ink-jet heads 1A, 1B, on the basis of the ejection data stored in the image-data storage portion 131. Further, the head control portion 132 is configured to drive only the actuator units 21 of the black ink-jet head 1A where the printing-mode judge portion 133 judges that the monochrome printing mode is to be established and to drive the actuator units 21 of all of the ink-jet heads 1A, 1B where the printing mode judge portion 133 judges that the color printing mode is to be established. Moreover, the head control portion 132 is configured to drive the actuator units 21 of the pre-coat head 2 only where the pretreatment-mode judge portion 134 judges that the pretreatment mode is to be established.

The image-data change portion 135 is configured to change the ejection data stored in the image-data storage portion 131 such that a formation ratio of image dots formed by composite black with respect to image dots formed by the black ink is larger only in an instance where the pretreatment-mode judge portion 134 judges that the pretreatment mode is to be established and the printing-mode judge portion 133 judges that the color printing mode is to be established, than in an instance where the pretreatment-mode is not to be established, namely, where the non-pretreatment mode is to be established. Here, the composite black is a color constituted by overlapping, on the sheet P, of the droplets of the three color inks ejected from the three color ink-jet heads 1B other than the black ink-jet head 1A. That is, the image-data change portion 135 is configured to change the ejection data as follows: among a plurality of image dots that constitute an image to be printed on the sheet P, a part of the plurality of image dots to be formed by ejecting the black ink is replaced with image dots to be formed by the composite black ink, such that the formation ratio, in the pretreatment mode, of the image dots to be formed by the composite black ink with respect to the image dots to be formed by ejecting the black ink is larger than that in the non-pretreatment mode.

The flushing control portion 136 is configured to control, only where the pretreatment-mode judge portion 134 judges that the pretreatment mode is to be established, each of the heads 1A, 1B to perform ejection flushing for ejecting minute ink droplets from the ejection openings 108 of each of the heads 1A, 1B after a lapse of a predetermined time from initiation of conveyance of the sheet P until a non-image-forming region of the sheet P on which an image is not to be formed is opposed to the ejection openings 108 of each of the heads 1A, 1B. In this ejection flushing, one ink droplet ejected from each ejection opening 108 to the sheet P is too minute to be visible to the naked eye when the droplet is attached to the sheet P. That is, the flushing control portion 136 recognizes the non-image-forming region of the sheet P from the ejection data stored in the image-data storage portion 131 and drives the actuator units 21 of each of the heads 1A, 1B such that the ink droplets by the ejection flushing are ejected to the sheet P when the non-image-forming region and the ejection openings 108 of each of the heads 1A, 1B are opposed to each other. Further, the flushing control portion 136 is configured to drive the actuator units 21 of each of the heads 1A, 1B, where the printing-mode judge portion 133 judges that the color printing mode is to be established, such that the closer each of the ink-jet heads 1A, 1B is disposed relative to the pre-coat head 2 in the conveyance direction, the greater a number of times in which the ejection flushing is performed in each of the heads 1A, 1B, in other words, such that the number of times in which the ejection flushing is performed in each of the heads 1A, 1B decreases in order from one of the ink-jet heads 1B that is immediately adjacent to the pre-coat head 2 in the conveyance direction. The arrangement reduces the number of times in which the ejection flushing is performed in the black ejecting head 1A that is relatively away or remote from the pre-coat head 2, thereby decreasing an amount of the ink consumed by the ejection flushing in the black ink-jet head 1A. In addition, the number of times in which the ejection flushing is performed is large in the one of the color ink-jet heads 1B that is immediately adjacent to the pre-coat head 2. Accordingly, it is possible to restrain the mist of the pre-coat liquid ejected from the pre-coat head 2 from adhering to and depositing on the vicinity of the ejection openings 108 of that one color ink-jet head 1B, thereby preventing ejection failure due to fixation of the deposited liquid mist.

The maintenance control portion 137 as a head-movement control portion is configured to control the up-down movement of the frames 35*a*-35*c* by the head moving mechanism 33 and the movement of the caps 71-73 and the trays 76-78 of the capping mechanism 34, on the basis of the results of judgment by the printing-mode judge portion 133 and the pretreatment-mode judge portion 134. More specifically, the maintenance control portion 137 is configured to control the head moving mechanism 33 and the capping mechanism 34 such that the ejection surfaces 1*a* of the three color ink-jet heads 1B other than the black ink-jet head 1A are covered with the caps 72 after the three color ink-jet heads 3B have been moved from the printing position to the retracted position, where the pretreatment-mode judge portion 134 judges that the pretreatment mode is to be established and the printing-mode judge portion 133 judges that the monochrome printing mode is to be established. This arrangement more effectively prevents the mist of the pre-coat liquid ejected from the pre-coat head 2 from adhering to the vicinity of the ejection openings 108 of the three color ink-jet heads 1B each as the specific third ejecting head. Further, the maintenance control portion 137 is configured to control the head moving mechanism 33 and the capping mechanism 34 such that the ejection surfaces 1*a*, 2*a* of all of the heads 1, 2 are kept covered with the corresponding caps 71-73 until the next printing operation starts after completion of the current printing operation. According to this arrangement, it is possible to restrain the inks or the pre-coat liquid in the ejection openings 108 of the heads 1, 2 from drying during a non-printing period. Here, the retracted position is defined as a position located above the printing position in a direction away from the conveyor belt 8. As mentioned above, when each of the heads 1, 2 is located at the retracted position, the space in which the caps 71-73 and the trays 76-78 can be disposed is formed between the conveyor surface of the conveyor belt 8 and the ejection surface 1*a*, 2*a* of each of the heads 1, 2.

Figure 7:
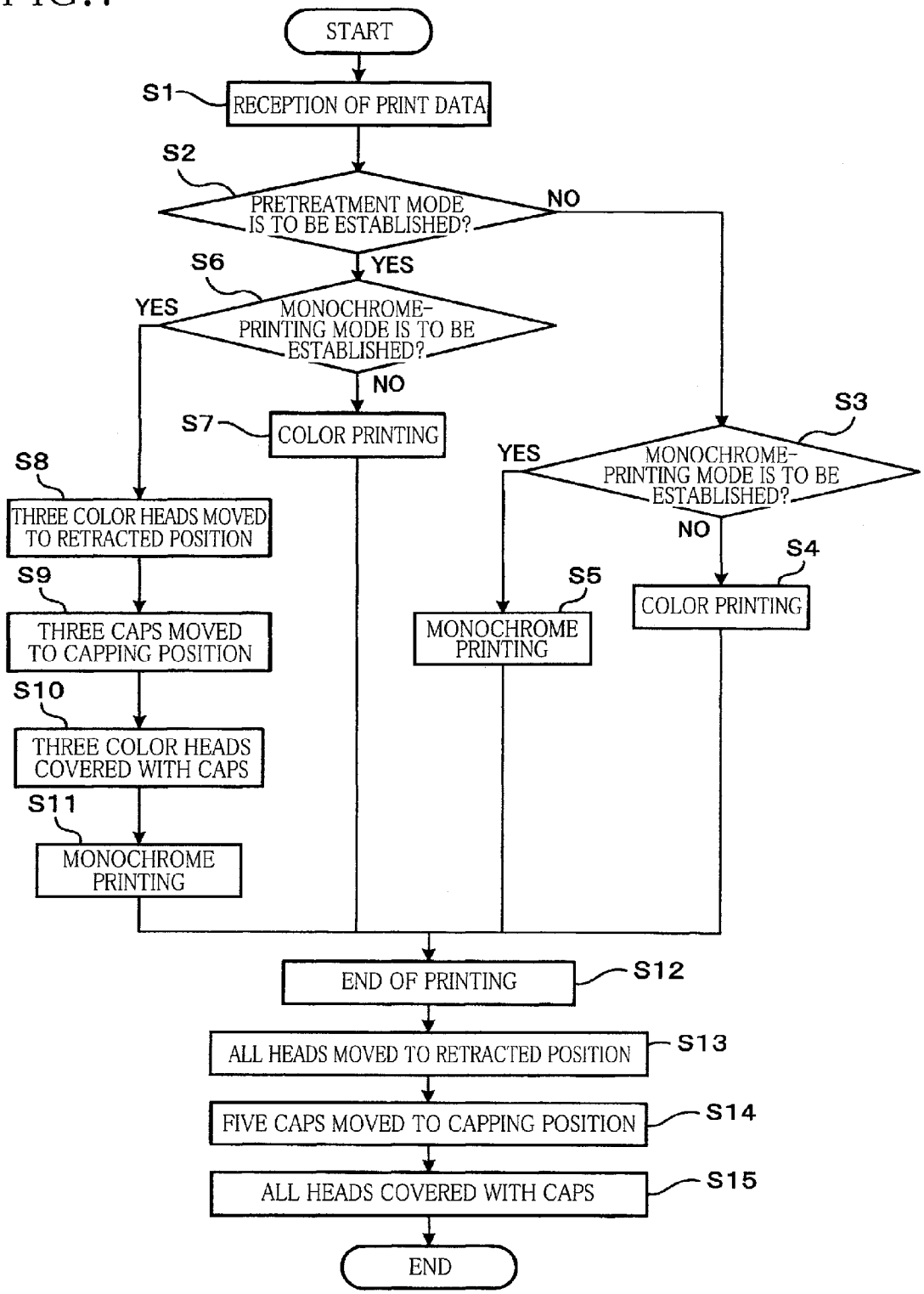
FIG. 7 is a flow chart showing a printing operation of the ink-jet printer shown in FIG. 1.

Next, the printing operation by the ink-jet printer 101 will be explained with reference to the flow chart of FIG. 7. As shown in FIG. 7, in step 1 (S1), the ink-jet printer 101 initially receives, from a PC or the like, print data including image data, a signal indicative of the type of the sheet P and so on. In this instance, the image-data storage portion 131 stores the image data included in the print data as ejection data for ejecting the inks and the pre-coat liquid from the heads 1, 2.

Next, the pretreatment-mode judge portion 134 judges in step 2 (S2) whether or not the pretreatment mode is to be established, on the basis of the signal indicative of the type of the sheet P. Where the pretreatment-mode judge portion 134 judges that the non-pretreatment mode is to be established, the control flow goes to step 3 (S3).

In step 3, the printing-mode judge portion 133 judges on the basis of the ejection data stored in the image-data storage portion 131 whether the monochrome printing mode is to be established or not. Where the printing-mode judge portion 133 does not judge that the monochrome printing mode is to be established, the color printing mode is judged to be established and the control flow goes to step 4 (S4). Where the printing-mode judge portion 133 judges that the monochrome printing mode is to be established, the control flow goes to step 5 (S5).

In step 4, the conveyance control portion 130 controls the sheet supply unit 101*b*, the feed roller pairs 14, 28, and the sheet conveyor mechanism 16 such that the sheet P is conveyed along a sheet feeding route in the printer. In this instance, the head control portion 132 drives the actuator units 21 of each of the heads 1A, 1B on the basis of the ejection data stored in the image-data storage portion 131, so as to permit ink droplets each having an intended volume to be ejected from the ejection openings 108 at intended timing. Thus, a color image is formed at an intended location of the sheet P conveyed by the sheet conveyor mechanism 16, whereby the printing operation on the sheet P is ended in step 12 (S12).

In step 5, the conveyance control portion 130 controls the sheet supply unit 101*b*, the feed roller pairs 14, 28, and the sheet conveyor mechanism 16 such that the sheet P is conveyed along the sheet feeding route in the printer. In this instance, the head control portion 132 drives only the actuator units 21 of the black ink-jet head 1A on the basis of the ejection data stored in the image-data storage portion 131, so as to permit ink droplets each having an intended volume to be ejected from the ejection openings 108 at intended timing. Thus, a monochrome image is formed at an intended location of the sheet P conveyed by the sheet conveyor mechanism 16, and the printing operation on the sheet P is ended in step 12 (S12).

On the other hand, where the pretreatment-mode judge portion 134 judges in step 2 that the pretreatment is to be established, the control flow goes to step 6 (S6). As in the above-indicated step 3, the printing-mode judge portion 133 judges in step 6 whether or not the monochrome printing mode is to be established. In this instance, where the printing-mode judge portion 133 does not judge that the monochrome printing mode is to be established, the color printing mode is judged to be established and the control flow goes to step 7 (S7). Where the printing-mode judge portion 133 judges that the monochrome printing mode is to be established, the control flow goes to step 8 (S8).

In step 7, the conveyance control portion 130 controls the sheet supply unit 101*b*, the feed roller pairs 14, 28, and the sheet conveyor mechanism 16 such that the sheet P is conveyed along the sheet feeding route in the printer. In this instance, the image-data change portion 135 changes the ejection data stored in the image-data storage potion 131, such that the formation ratio, in the pretreatment mode, of the image dots formed by the composite black with respect to the image dots formed by ejecting the black ink is larger than that in the non-pretreatment mode (step 4). Then the head control portion 132 controls the pre-coat head 2 to eject droplets of the pre-coat liquid from the ejection openings 108 at intended timing and controls each of the ink-jet heads 1A, 1B to eject droplets of the corresponding ink from the ejection openings 108 at intended timing, on the basis of the changed ejection data. The composite black formed by mixing a plurality of color inks has a higher degree of lightness than the black ink as a single color, so that, even if the ink trapping phenomenon occurs, the phenomenon is inconspicuous. Further, the amount of the ink ejected from each of the three color ink-jet heads 1B is increased by increasing the formation ratio of the image dots formed by the composite black in the pretreatment mode, as compared with that in the non-pretreatment mode, whereby the mist of the pre-coat liquid is unlikely to adhere to the vicinity of the ejection openings 108 of the heads 1B. Accordingly, it is possible to obviate ejection failure which would be caused by adhesion and deposition of the mist of the pre-coat liquid ejected from the pre-coat head 2 to and on the vicinity of the ejection openings 108 of the three color ink-jet heads 1B.

In this instance, the flushing control portion 136 drives the actuator units 21 of each of the heads 1A, 1B such that minute ink droplets are periodically ejected to the sheet P by the ejection flushing (preliminary ejection) when the non-image-forming region of the sheet P and the ejection openings 108 of each of the heads 1A, 1B are opposed to each other. According to the arrangement, the minute ink droplets are ejected from the ejection openings 108 which have not contributed to the printing operation for a long time period, thereby restraining clogging of the ejection openings 108 which have not contributed to the printing operation for a long time period, by the mist of the pre-coat liquid generated by ejection from the pre-coat head 2. Further, the flushing control portion 136 drives the actuator units 21 of each of the heads 1A, 1B, such that the closer each of the heads 1A, 1B is located relative to the pre-coat head 2 in the conveyance direction, the greater the number of times in which the ejection flushing is performed in each of the heads 1A, 1B. According to the arrangement, the mist of the pre-coat liquid is unlikely to adhere to the ejection openings 108 of each of the heads 1A, 1B located closer to the pre-coat head 2. Further, the more distant each of the heads 1A, 1B is from the pre-coat head 2, the smaller the number of times in which the ejection flushing is performed in each of the heads 1A, 1B. Accordingly, the total ink consumption amount by the ejection flushing can be reduced. Further, one 1B of the heads 1B that is immediately adjacent to the pre-coat head 2 ejects the yellow ink having the highest lightness. Therefore, even where the number of times of the ejection flushing in this head is large, the ink droplets ejected by the ejection flushing and attached to the sheet P are inconspicuous on the sheet P. Accordingly, by thus increasing the number of times of the ejection flushing, the ejection failure can be prevented. Thus, a color image is formed at an intended location of the sheet P conveyed by the sheet conveyor mechanism 16, and the printing operation on the sheet P is ended in step 12 (S12).

Figure 8A:
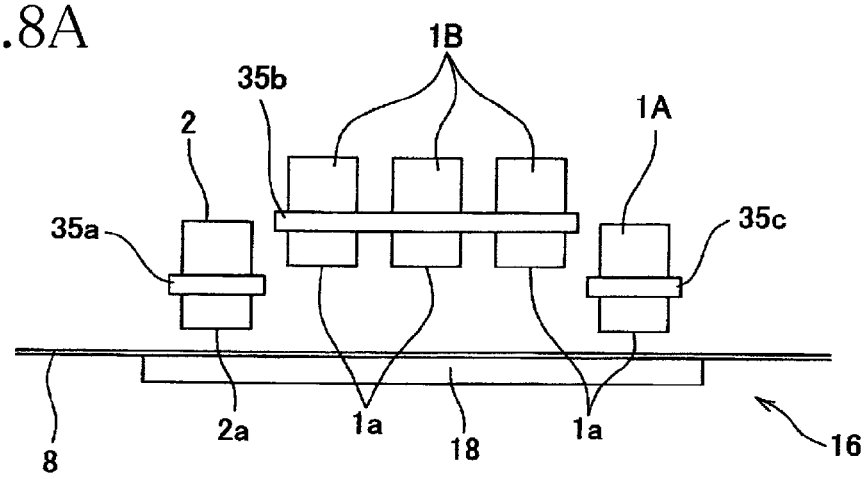
FIGS. 8A-8C are views showing an operation of capping three ink-jet heads configured to eject respective color inks.
Figure 8B:
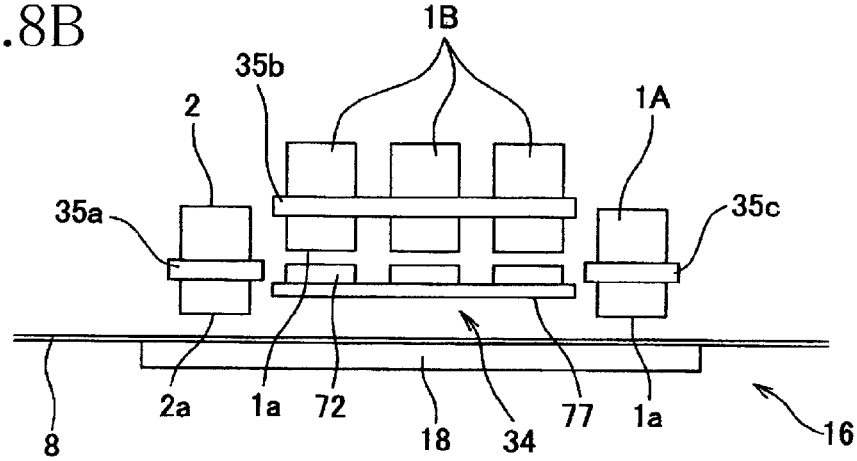

In step 8, the maintenance control portion 137 controls the head moving mechanism 33 such that the three color ink-jet heads 1B are moved from the print position to the retracted position as shown in FIG. 8A. Subsequently, in step 9 (S9), the maintenance control portion 137 controls the capping mechanism 34 such that the three caps 72 and the tray 77 are moved from the standby position to the capping position as shown in FIG. 8B, so that the ejection surfaces 1*a* of the respective ink-jet heads 1B moved to the retracted position are opposed to the corresponding caps 72.

Figure 8C:
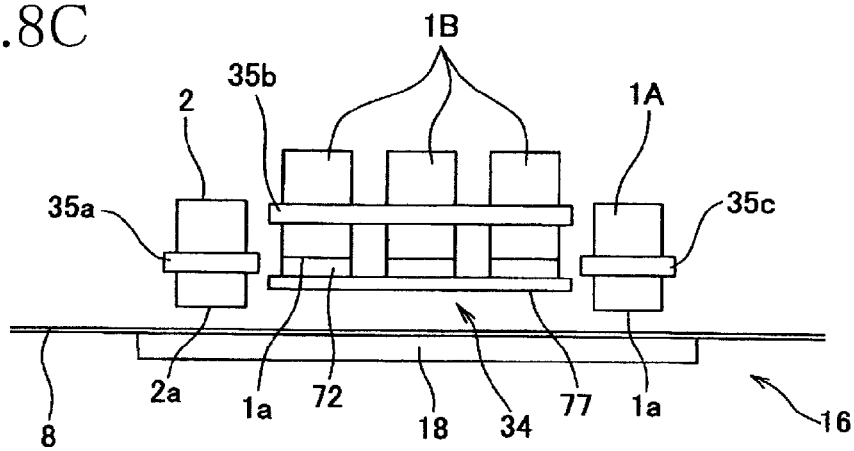

Thereafter, in step 10 (S10), the maintenance control portion 137 controls the head moving mechanism 33 such that the three ink-jet heads 1B are slightly lowered from the retracted position until the ejection surfaces 1*a* of the heads 1B are brought into contact with the corresponding caps 72 as shown in FIG. 8C. As a result, the ejection surfaces 1*a* of the three color ink-jet heads 1B are covered with the respective caps 72. Accordingly, the mist of the pre-coat liquid generated by ejection from the pre-coat head 2 is not likely to adhere to the vicinity of the ejection openings 108 of the three color ink-jet heads 1B.

Subsequently, in step 11 (S11), the conveyance control portion 130 controls the sheet supply unit 101*b*, the feed roller pairs 14, 28, and the sheet conveyor mechanism 16 such that the sheet P is conveyed along the sheet feeding route in the printer. On this occasion, the head control portion 132 controls the pre-coat head 2 to eject droplets of the pre-coat liquid from the ejection openings 108 at intended timing and controls the black ink-jet head 1A to eject ink droplets from the ejection openings 108 at intended timing. Further, on this occasion, the flushing control portion 136 drives the actuator units 21 of the ink-jet head 1A such that minute ink droplets are periodically ejected to the sheet P by the ejection flushing when the non-image-forming region of the sheet P and the ejection openings 108 of the head 1A are opposed to each other. As a result, the minute ink droplets are ejected from the ejection openings 108 that have not contributed to the printing operation for a long time, thereby restraining clogging of the ejection openings 108 which have not contributed to the printing operation for a long time period, by the mist of the pre-coat liquid generated by ejection from the pre-coat head 2. Thus, a monochrome image is formed at an intended location of the sheet P conveyed by the sheet conveyor mechanism 16, and the printing operation on the sheet P is ended in step 12 (S12).

Figure 9A:
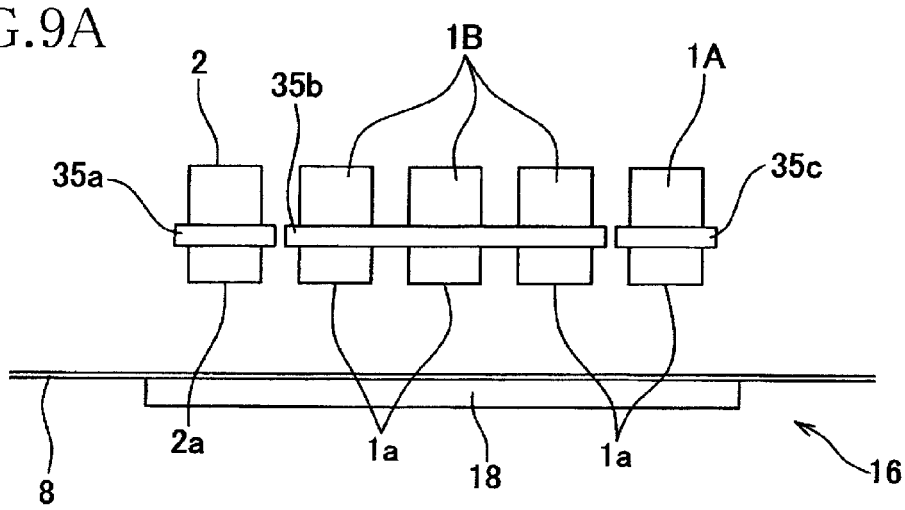
FIGS. 9A-9C are views showing an operation of capping a pre-coat head and four ink-jet heads.
Figure 9B:
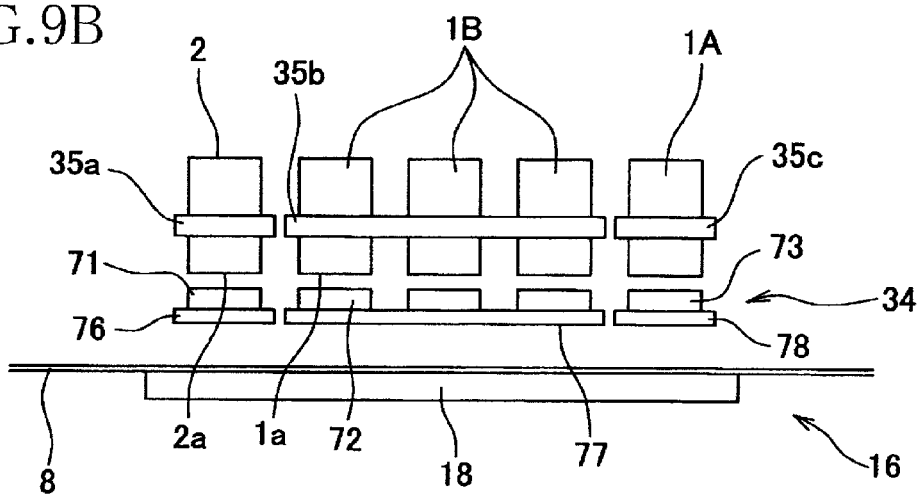

Until the next printing operation starts after completion of the current printing operation, the maintenance control portion 137 controls in step 13 (S13) the head moving mechanism 33 such that all of the heads 1, 2 are moved from the print position to the retracted position as shown in FIG. 9A. Subsequently, in step 14 (S14), the maintenance control portion 137 controls the capping mechanism 34 such that the five caps 71-73 and the three trays 76-78 are moved from the standby position to the capping position as shown in FIG. 9B, whereby the ejection surfaces 1*a*, 2*a* of the heads 1, 2 and the five caps 71-73 are opposed to each other.

Figure 9C:
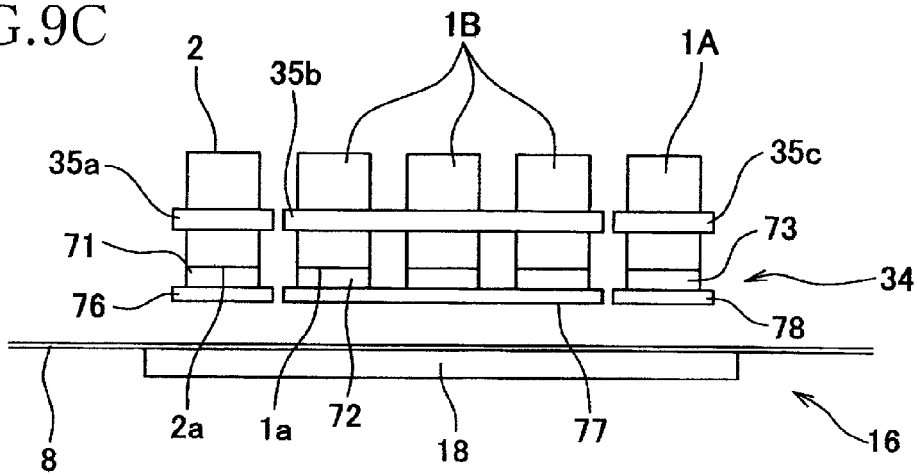

Thereafter, in step 15 (S15), the maintenance control portion 137 controls the head moving mechanism 33 such that the heads 1, 2 are slightly lowered from the retracted position until the ejection surfaces 1*a*, 2*a* and the caps 71-73 are brought into contact with each other as shown in FIG. 9C, whereby the ejection surfaces 1*a*, 2*a* of the heads 1, 2 are covered with the caps 71-73. Accordingly, it is possible to restrain drying of the ink or the pre-coat liquid in the ejection openings 108 of each of the heads 1, 2 in a period during which the printing operation is not being performed. Thus, the printing operation is ended. It is noted that motions contrary to those in steps 13-15 are conduced where, in step 1, the ejection surfaces 1*a*, 2*a* are in a state in which the ejection surfaces 1*a*, 2*a* are covered with the respective caps 71-73, whereby all of the heads 1, 2 are disposed at the print position. More specifically, where the ejection surfaces 1*a*, 2*a* are covered with the respective caps 71-73 in step 1, the heads 1, 2 are initially moved up to the retracted position, then the caps 71-73 and the trays 76-78 are moved to the standby position, and the heads 1, 2 are finally moved to the print position.

In the ink-jet printer 101 according to the present embodiment, the three color ink-jet heads 1B are disposed between the pre-coat head 2 and the black ink-jet head 1A, so that the pre-coat head 2 and the black ink-jet head 1A are away from each other in the conveyance direction by a large distance. Accordingly, the mist of the pre-coat liquid is unlikely to adhere to the vicinity of the ejection openings 108 of the black ink-jet head 1A. Although the black ink-jet head 1A is disposed at the most downstream position in the conveyance direction for the purpose of being disposed well away from the pre-coat head 2, the five heads 1, 2 are disposed so as to be equally spaced apart from each other in the conveyance direction. Therefore, the size increase of the printer can be prevented. Further, the ejection surfaces 1*a* of the three color ink-jet heads 1B are covered with the respective caps 72 when the pretreatment mode and the monochrome printing mode are established, whereby the mist of the pre-coat liquid is unlikely to adhere to the vicinity of the ejection openings 108 of these three color ink-jet heads 1B. Accordingly, the three color ink-jet heads 1B do not tend to suffer from ink ejection failure.

Figure 10:
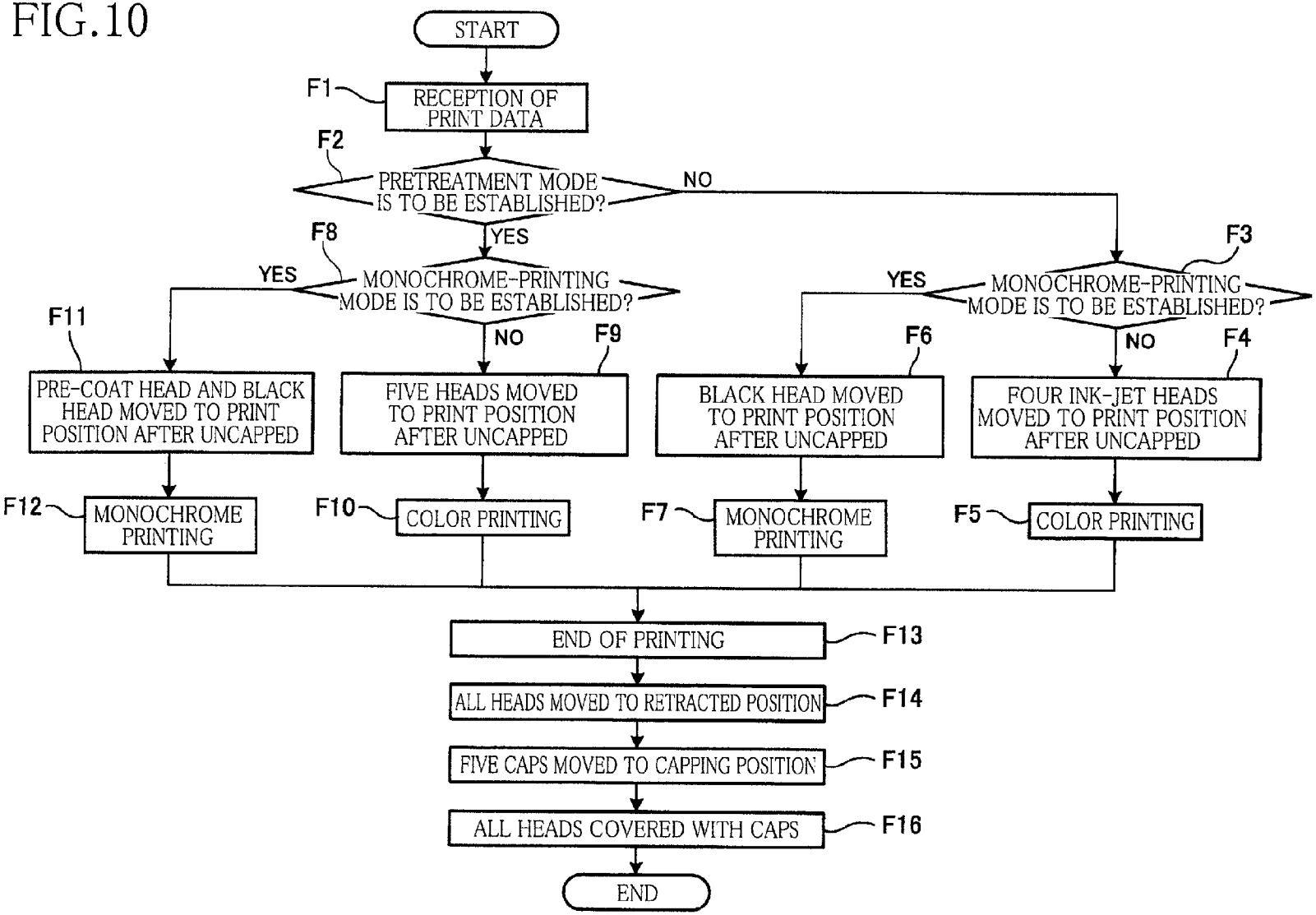
FIG. 10 is a flow chart showing a printing operation of the ink-jet printer according to one modified embodiment.

In the illustrated embodiment, where, in step 1, the ejection surfaces 1*a*, 2*a* are in a state in which the ejection surfaces 1*a*, 2*a* are covered with the respective caps 71-73, the motions contrary to those in steps 13-15 are conduced as explained above, whereby all of the heads 1, 2 are disposed at the print position. However, only some of the heads 1, 2 to be used may be uncapped and moved to the print position after it has been judged whether or not the monochrome printing mode is to be established. This arrangement will be explained as a first modified embodiment with reference to a flow chart of FIG. 10. In the flow chart shown in FIG. 10, steps F1-F3 similar to steps S1-S3 in the flow chart shown in FIG. 7 are initially implemented.

Where it is judged in step F3 that the color printing mode is to be established, the control flow goes to step F4. In step F4, the maintenance control portion 137 controls the head moving mechanism 33 to move the four ink-jet heads 1A, 1B up to the retracted position such that the caps 72, 73 and the ejection surfaces 1*a* of the heads 1A, 1B are spaced apart from one another for uncapping. Subsequently, the maintenance control portion 137 controls the capping mechanism 34 to move the four caps 72, 73 and the trays 77, 78 from the capping position to the standby position. Thereafter, the maintenance control portion 137 controls the head moving mechanism 33 to move the four ink-jet heads 1A, 1B from the retracted position to the print position.

Next, in step F5, the control similar to that in the above-described step S4 is executed, whereby the ink droplets are ejected at suitable timing from the ejection openings 108 of each of the heads 1A, 1B. Thus, a color image is formed at an intended location of the sheet P conveyed by the sheet conveyor mechanism 16, and the printing operation on the sheet P is ended in step F13.

Where it is judged in step F3 that the monochrome printing mode is to be established, the control flow goes to step F6 in which the maintenance control portion 137 controls the head moving mechanism 33 to move only the black ink-jet head 1A up to the retracted position such that the cap 73 and the ejection surface 1*a* of the black ink-jet head 1A are spaced apart from one another for uncapping. Subsequently, the maintenance control portion 137 controls the capping mechanism 34 to move only the cap 73 and the tray 78 from the capping position to the standby position. Thereafter, the maintenance control portion 137 controls the head moving mechanism 33 to move only the black ink-jet head 1A from the retracted position to the print position.

Next, in step F7 the control similar to that in the above-described step S5 is executed, whereby the ink droplets are ejected at suitable timing from the ejection openings 108 of the black ink-jet head 1A. Thus, a monochrome image is formed at an intended location of the sheet P conveyed by the sheet conveyor mechanism 16, and the printing operation on the sheet P is ended in step F13.

On the other hand, where the pretreatment-mode judge portion 134 judges in step F2 that the pretreatment mode is to be established, the control flow goes to step F8. As in the above-indicated step S6, the printing-mode judge portion 133 judges in step F8 whether or not the monochrome printing mode is to be established. In this instance, where the printing-mode judge portion 133 does not judge that the monochrome printing mode is to be established, the color printing mode is judged to be established and the control flow goes to step F9. Where the printing-mode judge portion 133 judges that the monochrome printing mode is to be established, the control flow goes to step F11.

In step F9, the maintenance control portion 137 controls the head moving mechanism 33 to move the five heads 1A, 1B, 2 up to the retracted position such that the caps 71-73 and the ejection surfaces 1*a*, 2*a* are spaced apart from one another for uncapping. Subsequently, the maintenance control portion 137 controls the capping mechanism 34 to move the five caps 71-73 and the trays 76-78 from the capping position to the standby position. Thereafter, the maintenance control portion 137 controls the head moving mechanism 33 to move the five heads 1A, 1B, 2 from the retracted position to the print position.

Next, in step F10, the control similar to that in the above-described step S7 is executed, whereby the droplets of the pre-coat liquid are ejected at suitable timing from the ejection openings 108 of the pre-coat head 2 and the ink droplets are ejected at suitable timing from the ejection openings 108 of each of the ink-jet heads 1A, 1B. On this occasion, the ejection flushing (preliminary ejection) for ejecting the ink droplets from the ejection openings 108 of each of the heads 1A, 1B is conducted. Thus, a color image is formed at an intended location of the sheet P conveyed by the sheet conveyor mechanism 16, and the printing operation on the sheet P is ended in step F13.

In step F11, the maintenance control portion 137 controls the head moving mechanism 33 to move the pre-coat head 2 and the black ink-jet head 1A up to the retracted position such that the caps 71, 73 and the ejection surfaces 1*a*, 2*a* are spaced apart from one another for uncapping. Subsequently, the maintenance control portion 137 controls the capping mechanism 34 to move the two caps 71, 73 and the trays 76, 78 from the capping position to the standby position. Thereafter, the maintenance control portion 137 controls the head moving mechanism 33 to move the pre-coat head 2 and the black ink-jet head 1A from the retracted position to the print position.

Next, in step F12, the control similar to that in the above-described step S11 is executed, whereby the droplets of the pre-coat liquid are ejected at suitable timing from the ejection openings 108 of the pre-coat head 2 and the ink droplets are ejected at suitable timing from the ejection openings 108 of the black ink-jet head 1A. On this occasion, the ejection flushing (preliminary ejection) for ejecting the ink droplets from the ejection openings 108 of the black ink-jet head 1A is conducted. Thus, a monochrome image is formed at an intended location of the sheet P conveyed by the sheet conveyor mechanism 16, and the printing operation on the sheet P is ended in step F13.

Subsequently, steps F13-F16 similar to the above-described steps S12-S15 are implemented. Thus, the printing operation is ended. Like the embodiment illustrated above, this first modified embodiment offers similar advantages in the similar structure.

As a second modified embodiment, only one or two of the three color ink-jet heads 1B, each as the specific third ejecting head, may be disposed between the pre-coat head 2 and the black ink-jet head 1A. In this instance, the rest of the color ink-jet heads 1B that is not disposed between the pre-coat head 2 and the black ink-jet head 1A, each as the third ejecting head, is disposed downstream of the black ink-jet head 1A. In this arrangement, the black ink-jet head 1A is disposed sufficiently away or remote from the pre-coat head 2 in the conveyance direction for preventing the mist of the pre-coat liquid from adhering to the vicinity of the ejection openings 108 of the black ink-jet head 1A. However, the distance by which the black ink-jet head 1A is away from the pre-coat head 2 is smaller than that in the embodiments illustrated above, thereby decreasing deviation of the attaching position of the pre-coat liquid on the sheet and the attaching position of the black ink on the sheet relative to each other. Further, as in the illustrated embodiments, the five heads 1, 2 are disposed so as to be equally spaced apart from each other in the conveyance direction, whereby the size increase of the printer can be prevented. In this second modified embodiment, the cap or caps corresponding to the above-indicated one or two color ink-jet head or heads 1B disposed between the pre-coat head 2 and the black ink-jet head 1A may be configured to be individually operated, whereby the ejection surface or surfaces 1*a* of the one or two color ink-jet head or heads 1B disposed between the pre-coat head 2 and the black ink-jet head 1A may be individually covered with the corresponding cap or caps in an instance where the pretreatment mode is to be established and the monochrome printing mode is to be established.

As a third modified embodiment, the capping mechanism 34 may be configured to have a cap or caps capable of covering the ejection surface or surfaces 1*a* of only the most upstream one or two of the three color ink-jet heads 1B which are disposed between the pre-coat head 2 and the black ink-jet head 1A, and the ejection surface or surfaces 1*a* may be covered with the corresponding cap or caps in an instance where the pretreatment mode is established and the monochrome printing mode is established.

As a fourth modified embodiment, the three color ink-jet heads 1B disposed between the pre-coat head 2 and the black ink-jet head 1A may be simply moved from the print position to the retracted position where the pretreatment mode is established and the monochrome printing mode is established, without providing the capping mechanism 34. According to this arrangement, the three color ink-jet heads 1B are relatively away from the ejection surface 2*a* of the pre-coat head 2 and the sheet conveyor mechanism 16, so that the mist of the pre-coat liquid is unlikely to adhere to the vicinity of the ejection openings 108 of the color ink-jet heads 1B. Only the most upstream one of the three color ink-jet heads 1B disposed between the pre-coat head 2 and the black ink-jet head 1A in the conveyance direction may be moved to the retracted position. As in the illustrated second modified embodiment, only one or two of the three color ink-jet heads 1B may be disposed between the pre-coat head 2 and the black ink jet head 1A. In this instance, the one or two color ink-jet head or heads 1B disposed between the pre-coat head 2 and the black ink-jet head 1A may be moved to the retracted position as described above.

In the illustrated embodiments, the most upstream one of the three color ink-jet heads 1B ejects the yellow ink having the highest lightness among the three color inks. Accordingly, even if the mist of the pre-coat liquid adheres to the most upstream color ink-jet head 1B to a larger extent than the other color ink-jet heads 1B, deviation of the attaching position on the sheet P of the ink ejected from the most upstream color ink-jet head 1B is inconspicuous.

As a fifth modified embodiment, the most upstream ink-jet head 1B among the four ink-jet heads 1A, 1B in the conveyance direction may eject the ink having the lowest lightness (e.g., the magenta ink), other than the black ink. According to the arrangement, after the color ink having the lowest lightness among the three color inks has been attached to the sheet P, the other color inks each having lightness higher than that of the previously ejected color ink are attached to the sheet P. Accordingly, even if each ink later attached to the sheet P deviates from an intended position when the ink sinks in the sheet P, namely, even if the ink trapping phenomenon occurs, the deviation is inconspicuous because each color ink later attached to the sheet P has the higher lightness. Further, since the pre-coat head 2 and the most upstream color ink-jet head 1B configured to eject the color ink having the lowest lightness are relatively close to each other in the conveyance direction, the attaching position of the pre-coat liquid ejected from the pre-coat head 2 and the attaching position of the magenta ink ejected from the most upstream color ink-jet head 1B are not likely to deviate relative to each other.

In the illustrated embodiments, it is possible to judge which one of the color printing or the monochrome printing is to be conducted with respect to the sheet P owing to provision of the printing-mode judge portion 133. Further, it is possible to judge whether or not the pretreatment is to be conducted with respect to the sheet P owing to provision of the pretreatment-mode judge portion 134.

While the embodiments of the invention have been explained, it is to be understood that the invention is not limited to the details of the illustrated embodiments, but may be embodied with various changes and modifications, which may occur to those skilled in the art, without departing from the spirit and scope of the invention defined in the attached claims.

In the illustrated embodiments, the three color ink-jet heads 1B are configured to eject the ink droplets of the respective different colors. Two color ink-jet heads 1B, or four or more color ink-jet heads 1B may be configured to eject ink droplets of mutually different colors.

It is noted that the present invention is applicable to a liquid ejecting apparatus configured to eject a liquid other than the ink. It is also noted that the present invention is applicable to a facsimile machine, a copying machine and the like, other than the printer.

The head control portion may be configured to drive heating elements of the pre-coat head and each ink-jet head for ejection of the pre-coat liquid and the ink, instead of driving the actuator units of the pre-coat head and the actuator units of each ink-jet head.

The action of the pre-coat liquid with respect to the ink may include coagulation or precipitation of the component in the ink (such as the pigment or the dye) by a chemical reaction as a result of mixture of the ink and the pre-coat liquid. Further, the action of the pre-coat liquid with respect to the ink may include coagulation or precipitation of the component in the ink (such as the pigment or the dye) without any chemical reaction. In general, a pre-coat liquid which causes coagulation of the pigment colorant is used for the pigment ink while a pre-coat liquid which causes precipitation of the dye colorant is used for the dye ink, as described above. The pre-coat liquid may have both of coagulation action and precipitation action.

The ejection data for ejecting the pre-coat liquid may be formed such that a predetermined amount of the pre-coat liquid is ejected to a region of the recording medium to which the ink ejected from each head 1 is to be attached. Instead, the ejection data for ejecting the pre-coat liquid may be formed such that the pre-coat liquid is ejected in an amount corresponding to an amount of the ink to be attached to each of local portions of the region of the recording medium.

In the illustrated embodiments, the explanation is made on the precondition that the lightness of the magenta ink is lower than that of the cyan ink. The lightness of the cyan ink may be lower than that of the magenta ink depending upon ink components.

What is claimed is:

1. A liquid ejecting apparatus, comprising:

a conveyor mechanism configured to convey a recording medium in a conveyance direction;

a first ejecting head which has a first ejection surface having first ejection openings formed therein for ejecting a black ink to the recording medium;

a second ejecting head which is disposed upstream of the first ejecting head in the conveyance direction and which has a second ejection surface having second ejection openings for ejecting a liquid that acts on an ink so as to cause one of coagulation and precipitation of a component in the ink;

a plurality of third ejecting heads which are disposed downstream of the second ejecting head in the conveyance direction and which respectively have third ejection surfaces having third ejection openings formed therein for ejecting color inks having mutually different colors other than black to the recording medium, the plurality of third ejecting heads including a specific third ejecting head disposed between the first ejecting head and the second ejecting head in the conveyance direction;

a head moving mechanism configured to move each of the second ejecting head and the specific third ejecting head between a print position and a retracted position, the print position being a position where the liquid is ejected from the second ejecting head to the recording medium and one of the color inks is ejected from the specific third ejecting head to the recording medium, and the retracted position being a position where each of the second ejecting head and the specific third ejecting head is spaced apart from the conveyor mechanism by a distance larger than that when each of the second ejecting head and the specific third ejecting head is located at the print position; and a controller which is configured to control the liquid ejecting apparatus and which includes:

an image-data storage portion configured to store image data of an image to be recorded on the recording medium as ejection data for ejecting the black ink and the color inks respectively from the first and third ejecting heads and the liquid from the second ejecting head;

a head control portion configured to control the first and the third ejecting heads to respectively eject the black ink and the color inks and to control the second ejecting head to eject the liquid, on the basis of the ejection data stored in the image-data storage portion, such that image dots are formed on the recording medium;

a head-movement control portion configured to control the head moving mechanism;

a printing-mode judge portion configured to judge which one of a monochrome printing mode and a color printing mode is to be established, the monochrome printing mode being for conducting monochrome printing in which only the black ink is ejected from the first ejecting head while the color printing mode is for conducting color printing in which the black ink is ejected from the first ejecting head and the color inks are ejected from the plurality of third ejecting heads; and a pretreatment-mode judge portion configured to judge which one of a pretreatment mode and a non-pretreatment mode is to be established, the pretreatment mode being for conducting a pretreatment in which the liquid is ejected from the second ejecting head to the recording medium while the non-pretreatment mode is a mode in which the liquid is not ejected from the second ejecting head and the pretreatment is not conducted, wherein the head control portion is configured to control the first ejecting head and the plurality of third ejecting heads to eject the black ink and the color inks to the recording medium where the printing-mode judge portion judges that the color printing mode is to be established and to control the first ejecting head to eject the black ink to the recording medium where the printing-mode judge portion judges that the monochrome printing mode is to be established, wherein the head control portion is configured to control the second ejecting head to eject the liquid to the recording medium where the pretreatment-mode judge portion judges that the pretreatment mode is to be established and to control the second ejecting head not to eject the liquid to the recording medium where the pretreatment-mode judge portion judges that the non-pretreatment mode is to be established, wherein the head-movement control portion is configured to control the head moving mechanism to move the specific third ejecting head from the print position to the retracted position where the pretreatment-mode judge portion judges that the pretreatment mode is to be established and the printing-mode judge portion judges that the monochrome printing mode is to be established, wherein the head-movement control portion is configured to control the head moving mechanism not to move the second ejecting head and the specific third ejecting head from the print position to the retracted position where the pretreatment-mode judge portion judges that the non-pretreatment mode is to be established and the printing-mode judge portion judges that the monochrome printing mode is to be established, and wherein the head-movement control portion is configured to control the head moving mechanism not to move the second ejecting head from the print position to the retracted position where the pretreatment-mode judge portion judges that the non-pretreatment mode is to be established and the printing-mode judge portion judges that the color printing mode is to be established.

2. The liquid ejecting apparatus according to claim 1, wherein the specific third ejecting head is disposed adjacent to the second ejecting head in the conveyance direction, and wherein the one of the color inks ejected from the specific third ejecting head has the lowest lightness among the color inks.

3. The liquid ejecting apparatus according to claim 1, wherein the specific third ejecting head is disposed adjacent to the second ejecting head in the conveyance direction, and wherein the one of the color inks ejected from the specific third ejecting head has the highest lightness among the color inks.

4. The liquid ejecting apparatus according to claim 1, further comprising a capping mechanism having a cap to cover the third ejection surface of the specific third ejecting head, wherein the head-movement control portion is configured to control, when the monochrome printing is conducted, the head moving mechanism and the capping mechanism such that the third ejection surface of the specific third ejecting head is covered with the cap after the specific third ejecting head has been moved from the print position to the retracted position.

5. The liquid ejecting apparatus according to claim 4, wherein the capping mechanism further has a plurality of caps to cover the first ejection surface of the first ejecting head, the second ejection surface of the second ejecting head, and the third ejection surface of at least one third ejecting head other than the specific third ejecting head, wherein the head moving mechanism is configured to move the first ejecting head between: a print position where the black ink is ejected from the first ejecting head; and a retracted position where the first ejecting head is spaced apart from the conveyor mechanism by a distance larger than that when the first ejecting head is located at the print position, and wherein the head-movement control portion is configured to control, when a printing operation on the recording medium is completed, the head moving mechanism and the capping mechanism such that the first through third ejection surfaces are covered with the plurality of caps after the first through third ejecting heads have been moved from the print position to the retracted position.

6. The liquid ejecting apparatus according to claim 1, wherein at least one third ejecting head other than the specific third ejecting head is disposed downstream of the first ejecting head in the conveyance direction.

7. The liquid ejecting apparatus according to claim 1, wherein each of the plurality of third ejecting heads is the specific third ejecting head.

8. The liquid ejecting apparatus according to claim 1, wherein the pretreatment-mode judge portion is configured to judge, on the basis of an externally input signal indicative of a type of the recoding medium, which one of the pretreatment mode and the non-pretreatment mode is to be established.

9. The liquid ejecting apparatus according to claim 8, wherein the controller further includes an image-data change portion configured to change the ejection data stored in the image-data storage portion such that a formation ratio of image dots formed by composite black that is constituted by overlapping of droplets of the color inks ejected from the plurality of third ejecting heads to the recording medium with respect to image dots formed by droplets of only the black ink ejected from the first ejecting head is larger in an instance where the pretreatment-mode judge portion judges that the pretreatment mode is to be established and the printing-mode judge portion judges that the color printing mode is to be established than in an instance where the pretreatment-mode judge portion judges that the non-pretreatment mode is to be established.

10. The liquid ejecting apparatus according to claim 1, wherein the controller further includes a flushing control portion configured to control the first ejecting head and the plurality of third ejecting heads to perform ejection flushing when the recording medium conveyed by the conveyor mechanism and the first and third ejection openings face each other, and wherein the flushing control portion is configured to control, where printing-mode judge portion judges that the color printing mode is to be established, the first ejecting head and the plurality of third ejecting heads such that a number of times in which the ejection flushing is performed in each of the heads decreases in order from one of the plurality of third ejecting heads that is disposed immediately adjacent to the second ejecting head in the conveyance direction.

* * * * *